US007559790B2

(12) United States Patent
Boeck et al.

(10) Patent No.: US 7,559,790 B2
(45) Date of Patent: Jul. 14, 2009

(54) ELECTRICAL PLUG MODULE

(75) Inventors: Werner Boeck, Gross-Umstadt (DE); Ralf Schmidt, Fuerth (DE); Martin Szelag, Bickenbach (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 12/023,122

(22) Filed: Jan. 31, 2008

(65) Prior Publication Data

US 2008/0200059 A1 Aug. 21, 2008

(30) Foreign Application Priority Data

Feb. 19, 2007 (DE) ..... 10 2007 008 465

(51) Int. Cl.
*H01R 11/20* (2006.01)

(52) U.S. Cl. ..... 439/409

(58) Field of Classification Search ..... 439/409, 439/410, 417
See application file for complete search history.

(56) References Cited

U.S. PATENT DOCUMENTS

| | | | | |
|---|---|---|---|---|
| 4,444,447 | A | 4/1984 | Markwardt | |
| 5,681,182 | A * | 10/1997 | Reichle | 439/417 |
| 6,080,006 | A * | 6/2000 | Broder | 439/409 |
| 6,116,943 | A * | 9/2000 | Ferrill et al. | 439/418 |
| 6,273,745 | B1 * | 8/2001 | Yeh | 439/404 |
| 6,406,324 | B1 * | 6/2002 | Duesterhoeft et al. | 439/409 |
| 6,682,363 | B1 * | 1/2004 | Chang | 439/409 |
| 6,872,090 | B2 * | 3/2005 | De Dios Martin | 439/417 |
| 7,001,204 | B1 * | 2/2006 | Lin | 439/418 |
| 7,066,764 | B2 * | 6/2006 | Bolouri-Saransar | 439/409 |
| 7,118,405 | B2 * | 10/2006 | Peng | 439/417 |
| 7,137,845 | B2 * | 11/2006 | Bernat et al. | 439/409 |
| 7,144,269 | B2 * | 12/2006 | Libby et al. | 439/409 |
| 7,234,961 | B2 * | 6/2007 | Arlitt et al. | 439/410 |
| 7,275,952 | B1 * | 10/2007 | Fabian et al. | 439/409 |
| 2004/0110410 | A1 * | 6/2004 | Boeck et al. | 439/417 |
| 2004/0137784 | A1 * | 7/2004 | Martin | 439/417 |
| 2004/0142592 | A1 * | 7/2004 | Peng | 439/409 |

(Continued)

FOREIGN PATENT DOCUMENTS

DE 203 03 530 U1 6/2003

(Continued)

OTHER PUBLICATIONS

Brochure from the Phoenix Contact GmbH & Co. KG entitled Phoenix Contact Inspiring Innovations, 2005.

*Primary Examiner*—Ross N Gushi
(74) *Attorney, Agent, or Firm*—Barley Snyder LLC

(57) ABSTRACT

An electrical plug module includes a first housing and a second housing. The first housing has terminal contacts and insulation displacement contacts arranged therein. Each of the insulation displacement contacts is electrically connected to one of the terminal contacts. The second housing has wire receiving openings for receiving individual conductors of a cable. The wire receiving openings correspond to the insulation displacement contacts and are arranged in at least two separate planes. The first housing and the second housing are rotatable relative to one another between an open position and a closed position. The individual conductors are insertable into the wire receiving openings in the open position and are electrically connected to the insulation displacement contacts in the closed position.

12 Claims, 8 Drawing Sheets

U.S. PATENT DOCUMENTS

| | | | | |
|---|---|---|---|---|
| 2004/0235335 | A1* | 11/2004 | Schoeffel et al. | 439/410 |
| 2005/0032412 | A1* | 2/2005 | Bolouri-Saransar et al. | 439/409 |
| 2005/0064759 | A1* | 3/2005 | Libby et al. | 439/409 |
| 2005/0260882 | A1* | 11/2005 | Bernat et al. | 439/409 |
| 2005/0287862 | A1* | 12/2005 | Castaldo | 439/409 |
| 2006/0030192 | A1* | 2/2006 | Boeck et al. | 439/344 |
| 2007/0066123 | A1* | 3/2007 | Arlitt et al. | 439/409 |
| 2008/0050965 | A1* | 2/2008 | Szelag et al. | 439/387 |
| 2008/0096417 | A1* | 4/2008 | Boeck et al. | 439/445 |
| 2008/0146073 | A1* | 6/2008 | Stein | 439/409 |

FOREIGN PATENT DOCUMENTS

| | | | |
|---|---|---|---|
| EP | 0 971 444 | A1 | 6/1999 |
| EP | 1 693 934 | A1 | 8/2006 |
| WO | WO 99/66598 | | 12/1999 |
| WO | WO 02/15340 | | 2/2002 |

* cited by examiner

ELECTRICAL PLUG MODULE

CROSS-REFERENCE TO RELATED APPLICATIONS

This application claims the benefit of the filing date under 35 U.S.C. § 119(*a*)-(*d*) of German Patent Application No. DE 10 2007 008 465.1, filed Feb. 19, 2007.

FIELD OF THE INVENTION

The invention relates to an electrical plug module comprising a first housing and a second housing wherein the first housing and the second housing are rotatable relative to one another between an open position and a closed position and individual conductors are insertable into wire receiving openings in the second housing in the open position and are electrically connected to insulation displacement contacts in the first housing in the closed position.

BACKGROUND

It is known to use 4-pole to 8-pole RJ45 plugs, for example, in data networks. In the case of the 8-pole RJ45 plug, in particular, the available fitting space for individual conductors of a cable is small, because of the relatively small spatial dimensions of the housing. Thus, only relatively thin individual conductors can be fitted therein. However, as a result of ever more stringent requirements, in particular with regard to electrical current carrying capacity, thicker individual conductors need to be able to be fitted to the RJ45 plug without increasing the housing dimensions.

It is also known that, for quick and simple fitting, the individual conductors of the cable are inserted into the housing and pressed together with plug-in contacts by, for example, pliers. However, this type of fitting is very time-consuming is not very suitable where space is tight. A further disadvantage is also that the pressed together terminal connections cannot be undone. Thus, in the case of a repair, the complete housing and also the cable will have to be replaced.

It has additionally been proposed to use insulation displacement contacts to simplify the connection between the individual conductors and the contact point in the electrical plug module. In an insulation displacement contact, the individual conductor is forced between two cutting edges, which are arranged at a short distance from one another, in such a way that the insulating jacket is cut through and the cutting edge comes into contact with a conducting wire therein to produce an electrical connection there between. However, the insulation displacement contacts have hitherto only been known for 4-pole RJ45 plugs. Moreover, the individual conductors cannot have an external diameter of more than 1.6 mm to be used with these electrical plug modules.

One example of an electrical plug module is known from DE 10 2004 038 123 A1. The electrical plug module comprises a first housing and a second housing. The first and second housings are rotatable relative to one another. A plug-in contact zone is rigidly connected to either the first housing or the second housing. An insulating device is fastened to the housing with the insulation displacement contacts. Further, a cable end receptacle capable of rotating is arranged between the first housing and the second housing. The cable end receptacle comprises four channels in which individual conductors of a cable to be connected to the electrical plug are inserted or plugged. By rotating the cable end receptacle with the cable in the direction of the first housing, the individual conductors are contacted and contacting proceeds as a result of the insulation displacement contacts. Disadvantageously, this electrical plug module is of relatively complex and costly construction due to the necessary cable end receptacle. Moreover, the fitting space is so tight that only four of the individual conductors can be fitted therein.

It is additionally known from the prior art that, in an 8-pole RJ45 plug, the individual conductors are cut to a final length by a diagonal cutter. The use of a diagonal cutter, however, is not typically very precise. The individual conductors are then connected to terminal contacts of the RJ45 plug by crimping, welding or soldering.

SUMMARY

It is therefore an object of the present invention is to provide an improved electrical plug module in particular for a RJ45 plug that can fit a plurality of individual conductors with an external diameter of more than 1.5 millimeters.

This and other objects are achieved by an electrical plug module comprising a first housing and a second housing. The first housing has terminal contacts and insulation displacement contacts arranged therein. Each of the insulation displacement contacts is electrically connected to one of the terminal contacts. The second housing has wire receiving openings for receiving individual conductors of a cable. The wire receiving openings correspond to the insulation displacement contacts and are arranged in at least two separate planes. The first housing and the second housing are rotatable relative to one another between an open position and a closed position. The individual conductors are insertable into the wire receiving openings in the open position and are electrically connected to the insulation displacement contacts in the closed position.

DETAILED DESCRIPTION OF THE EMBODIMENT(S)

Figure 1:
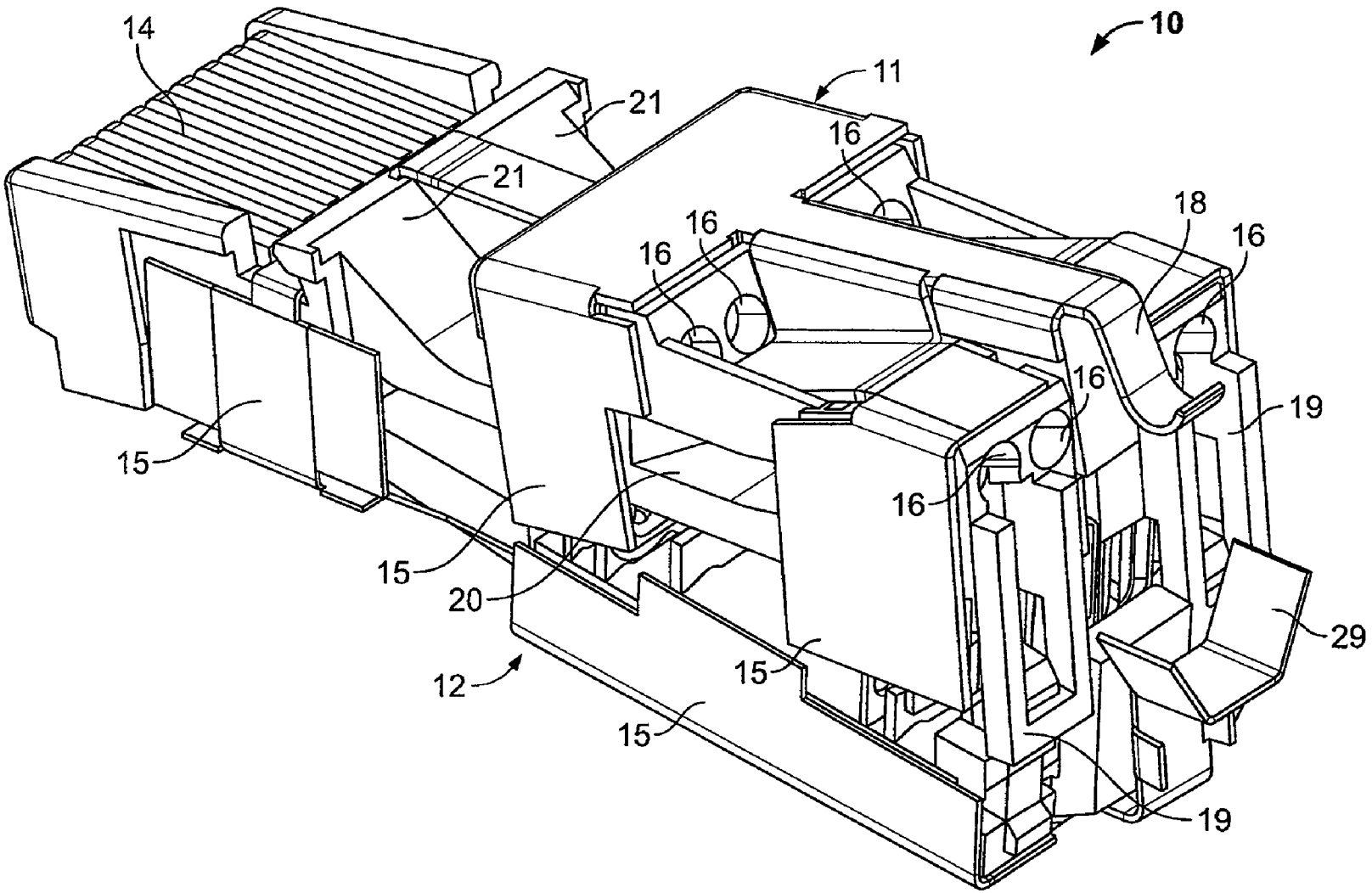
FIG. 1 is a perspective view of an electrical plug module shown in an open position.
Figure 2:
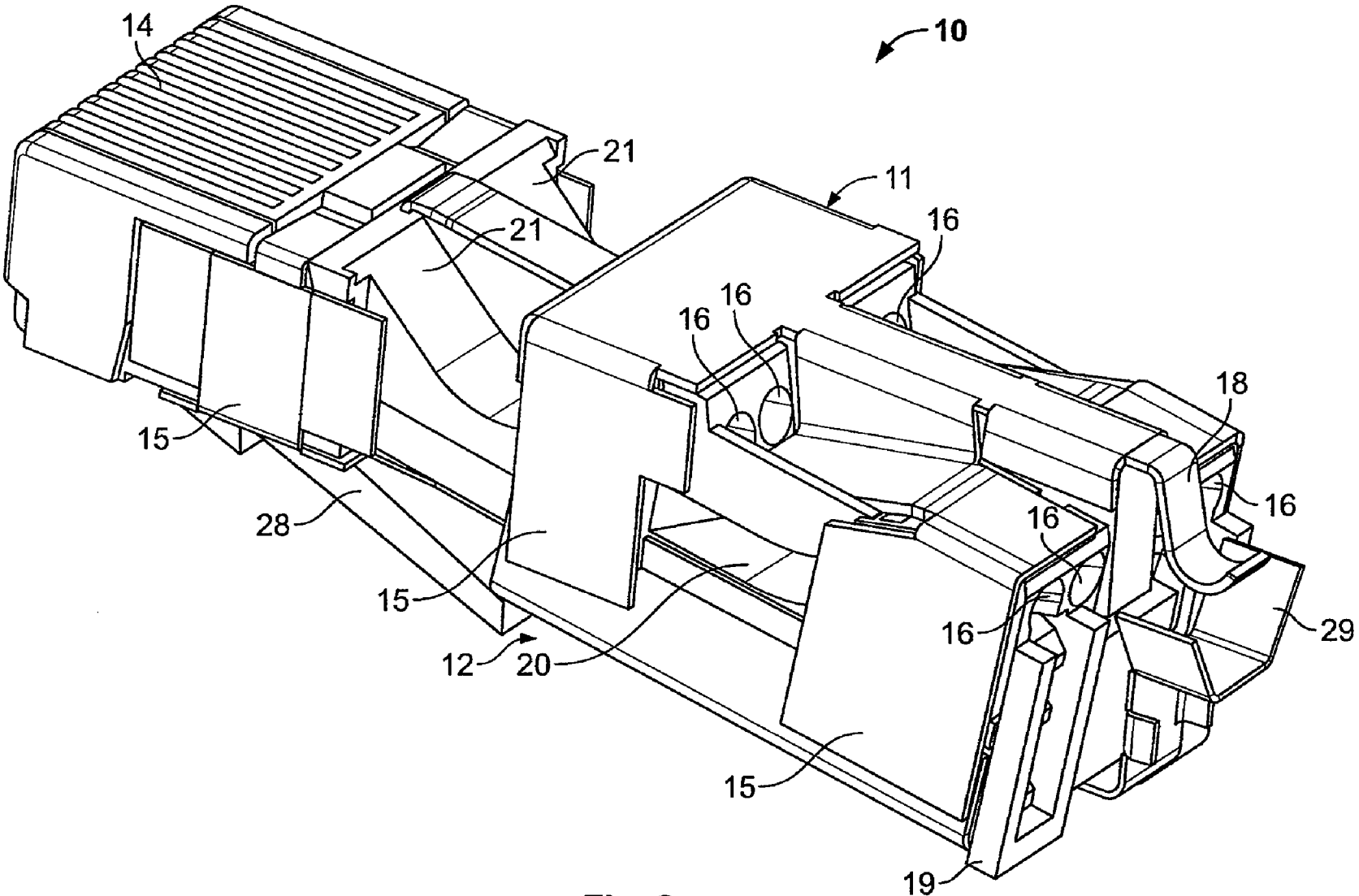
FIG. 2 is a perspective view of the electrical plug module shown in a closed position.
Figure 4:
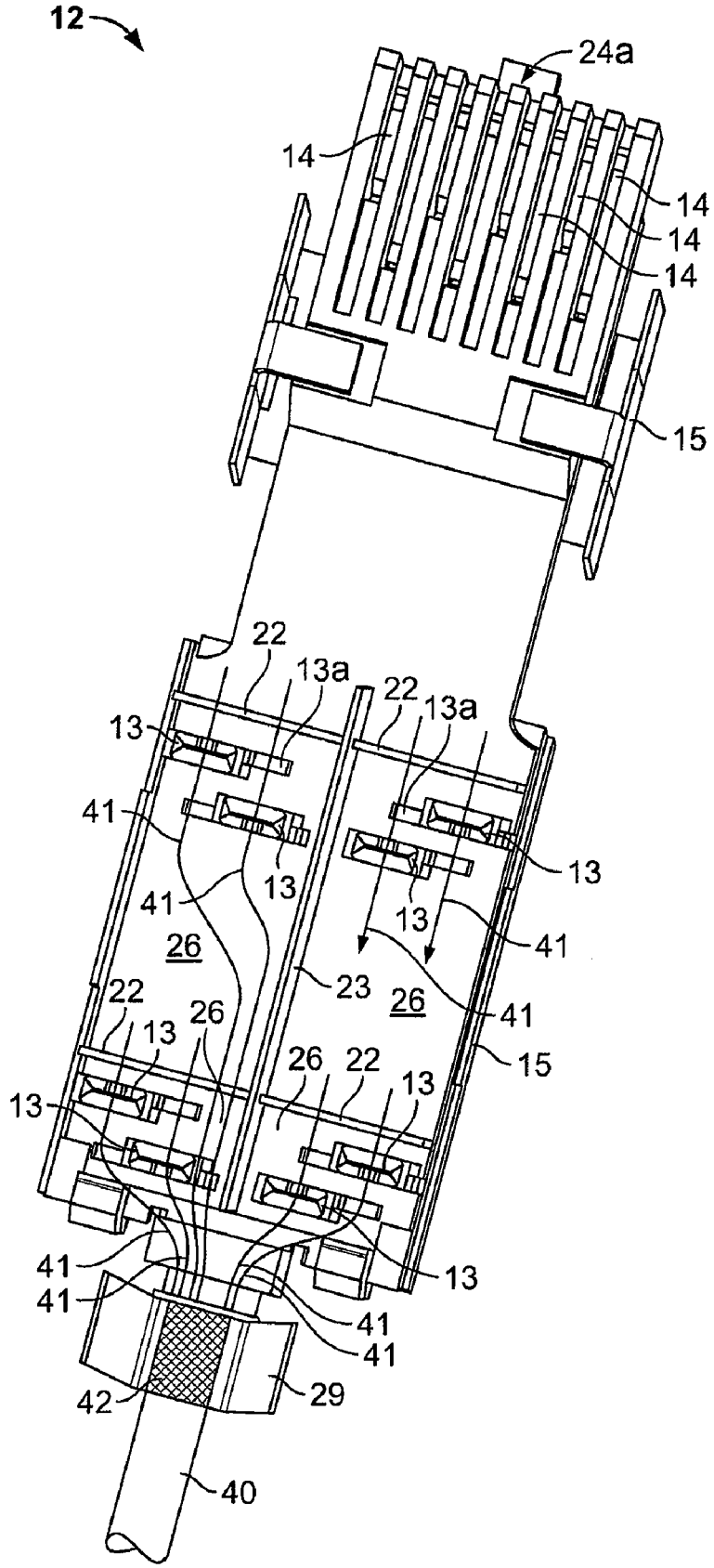
FIG. 4 is a plan view of the first housing of the electrical plug module.

FIGS. 1-2 show an electrical plug module 10 according to an embodiment of the invention. As shown in FIG. 4, the electrical plug module 10 is configured to receive a cable 40 comprising an outer cable jacket, a metal shield 42 and a plurality of individual conductors 41. The electrical plug module 10 may be used, for example, in an RJ45 plug-in connection. In the illustrated embodiment, the electrical plug module 10 is fitted with eight of the individual conductors 41; however, it will be appreciated by those skilled in the art that the number of the individual conductors 41 may vary depending on the desired application.

Figure 3:
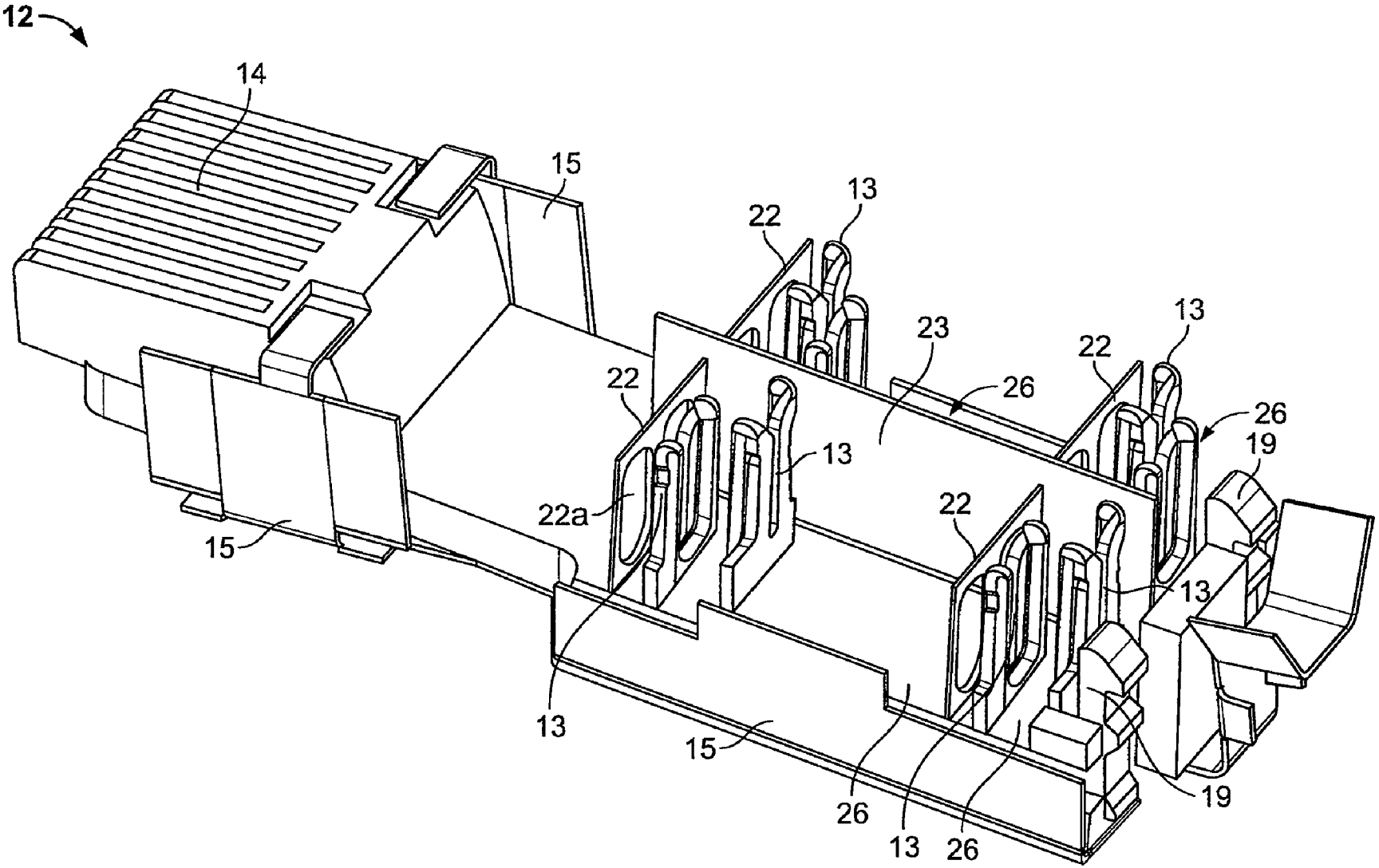
FIG. 3 is a perspective view of a first housing of the electrical plug module.

As shown in FIG. 1, the electrical plug module 10 comprises a first housing 12 that is substantially obliquely introduced into a second housing 11 from below. As shown in FIG. 3, the first housing 12 takes the form of a supporting printed circuit board. A central shield plate 23 and outer shield plate 15 is arranged on the first housing 12. The outer shield plate 15 substantially conforms to an outer surface of the first housing 12. Shield plates 22 are arranged substantially transversely to the central shield plate 23 such that a plurality of shielded chambers 26 is formed. Each of the shield plates 22 are provided with a cutting device, such as a steel blade, that is integrally formed therewith. Openings 22*a* are formed in the shield plates 22 and correspond to each of the conductors described below to ensure that no short circuit can arise during use of the plug module 10. The shield plates 22 and the central shield plate 23 are, for example, soldered together and are electrically connected to the outer shield plates 15.

Conductors are arranged in pairs in each of the shielded chambers 26. The conductors may be, for example, insulation displacement contacts 13. The insulation displacement contacts 13 are arranged in a staggered configuration at a slight distance in front of the shield plates 22 and adjacent the openings 22*a*. Each of the insulation displacement contacts 13 comprises a clamping gap configured to receive the individual conductor 41 to be contacted. The clamping gap is provided with cutting edges. As shown in FIG. 4, an insulation displacement contact pin 13*a* is arranged in laterally staggered manner adjacent to each of the insulation displacement contact 13. The insulation displacement contact pin 13*a* has the effect of compensating interference stemming from the insulation displacement contact 13 directly adjacent thereto.

A field with terminal contacts 14 is provided on an end of the first housing 12. The terminal contacts 14 are arranged in one row or plane. In a subsequent use such as for an RJ45 plug, the terminal contacts 14 assist in connection to an electronic device via a corresponding interface, for example to a computer, modem or the like. The terminal contacts 14 are connected to the insulation displacement contacts 13 via conductor tracks on the first housing 12. Thus, a reliable electrical connection exists between the individual conductors 41 of the cable 40 and the terminal contacts 14. A bearing edge 24*a* is provided adjacent to the field.

The first and second housings 12, 11 are provided with a latching device 19. The latching device 19 consists of hooks on the first housing 12 and eyelets on the second housing 11 that engage when the first and second housings 12, 11 are in a closed position, as shown in FIG. 2. As shown in FIG. 4, adjacent the latching device 19 on the first housing 12 is a metal clip 29 configured to support the metal shield 42 of the cable 40. The metal clip 29 is connected to the outer shield plate 15.

Figure 5:
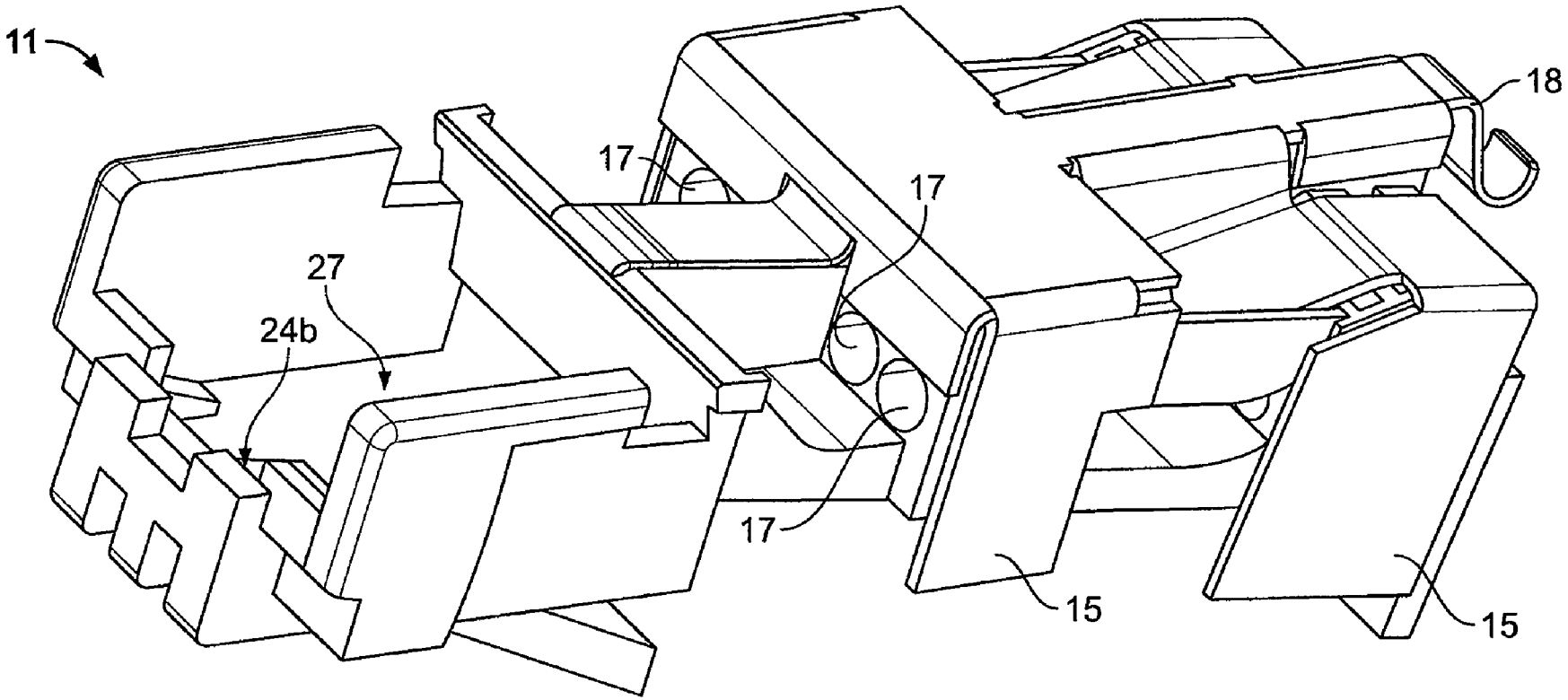
FIG. 5 is a top perspective view of a second housing of the electrical plug module from a front end thereof.
Figure 7:
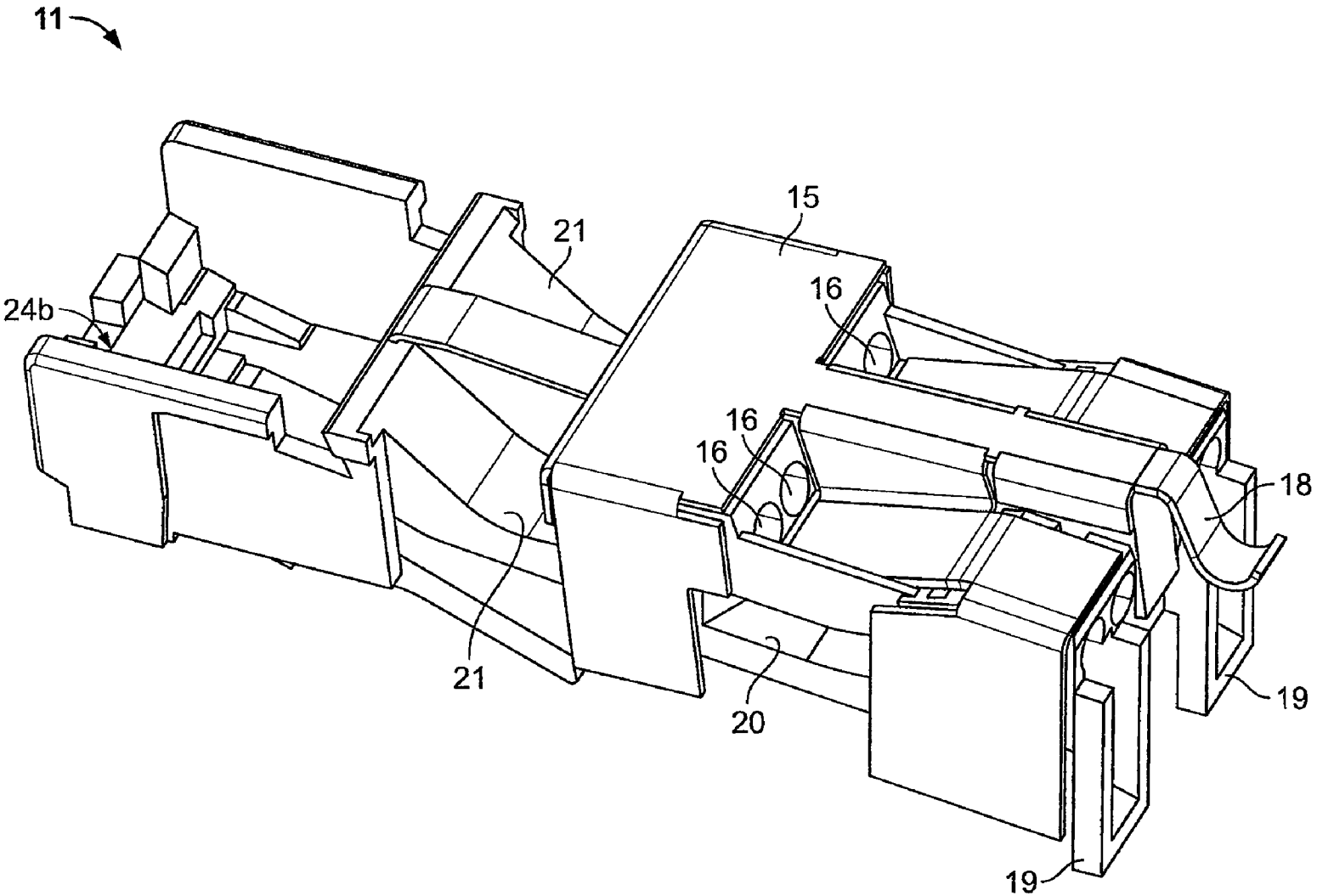
FIG. 7 is a top perspective view of a second housing of the electrical plug module from a rear end thereof.

As shown in FIG. 5, the second housing 11 has a frame-type construction and has an orifice 27. As shown in FIG. 7, outlet channels 20, 21 are arranged in separate planes and next to one another on the second housing 11. The outlet channels 20, 21 are configured to eject cut-off end pieces of the individual conductors 41.

The second housing 11 is provided with the outer shield plate 15, which conforms to an outer surface of the second housing 11. The outer shield plate 15 on the second housing 11 is provided with a resilient contact 18. This resilient contact 18 presses on the outer shield plate 15 such that the outer shield plate 15 contacts the jacket 42 of the cable 40.

Figure 6:
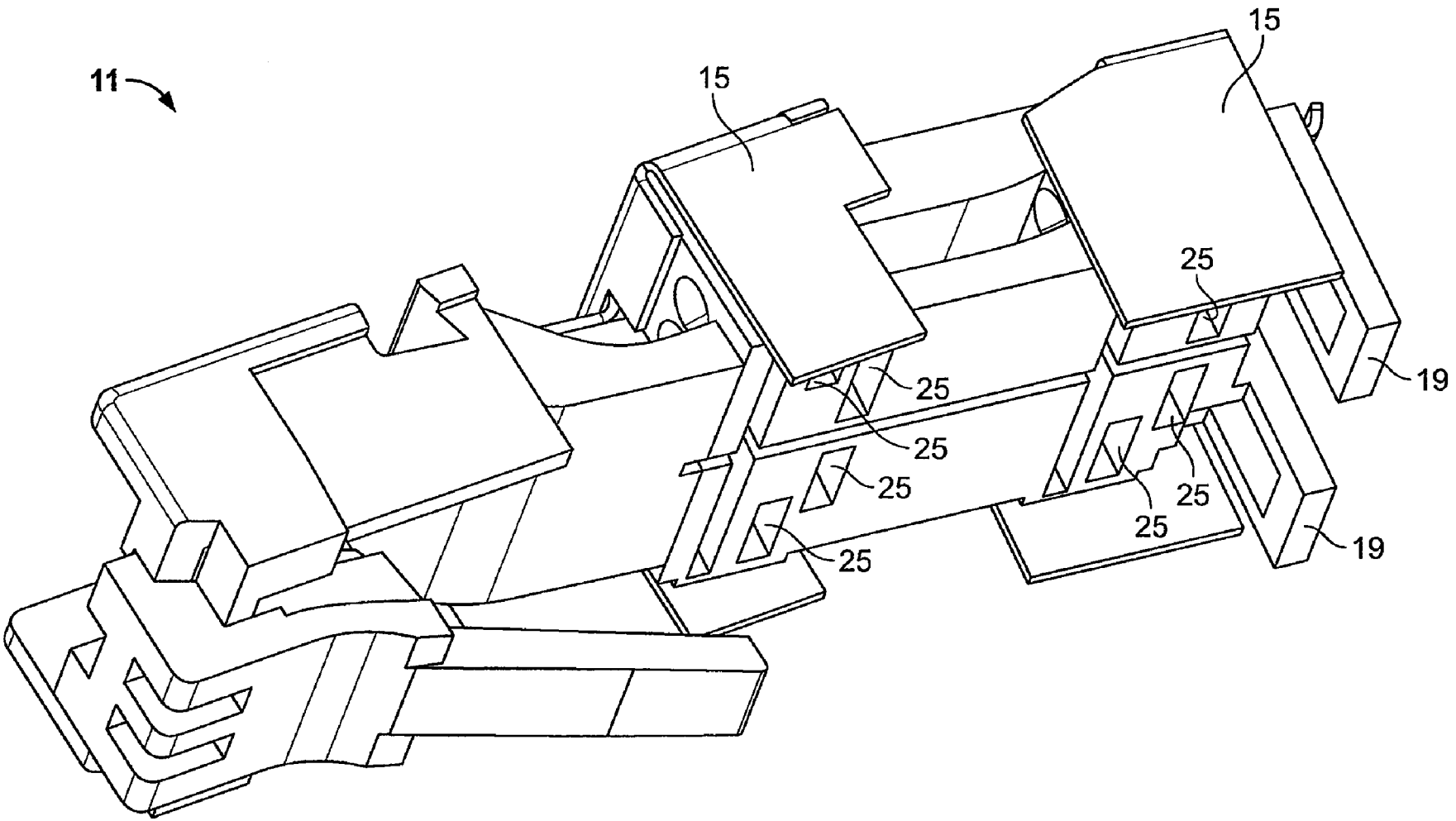
FIG. 6 is a bottom perspective view of the second housing of the electrical plug module.

As shown in FIG. 6, openings 25 are arranged at a bottom of the second housing 11. The openings 25 are arranged such that the individual insulation displacement contacts 13, which are mounted firmly on the first housing 12, pass there through and the first housing 12 rests against the bottom of the second housing 11 after pressing together of the second and first housings 11, 12.

Figure 8:
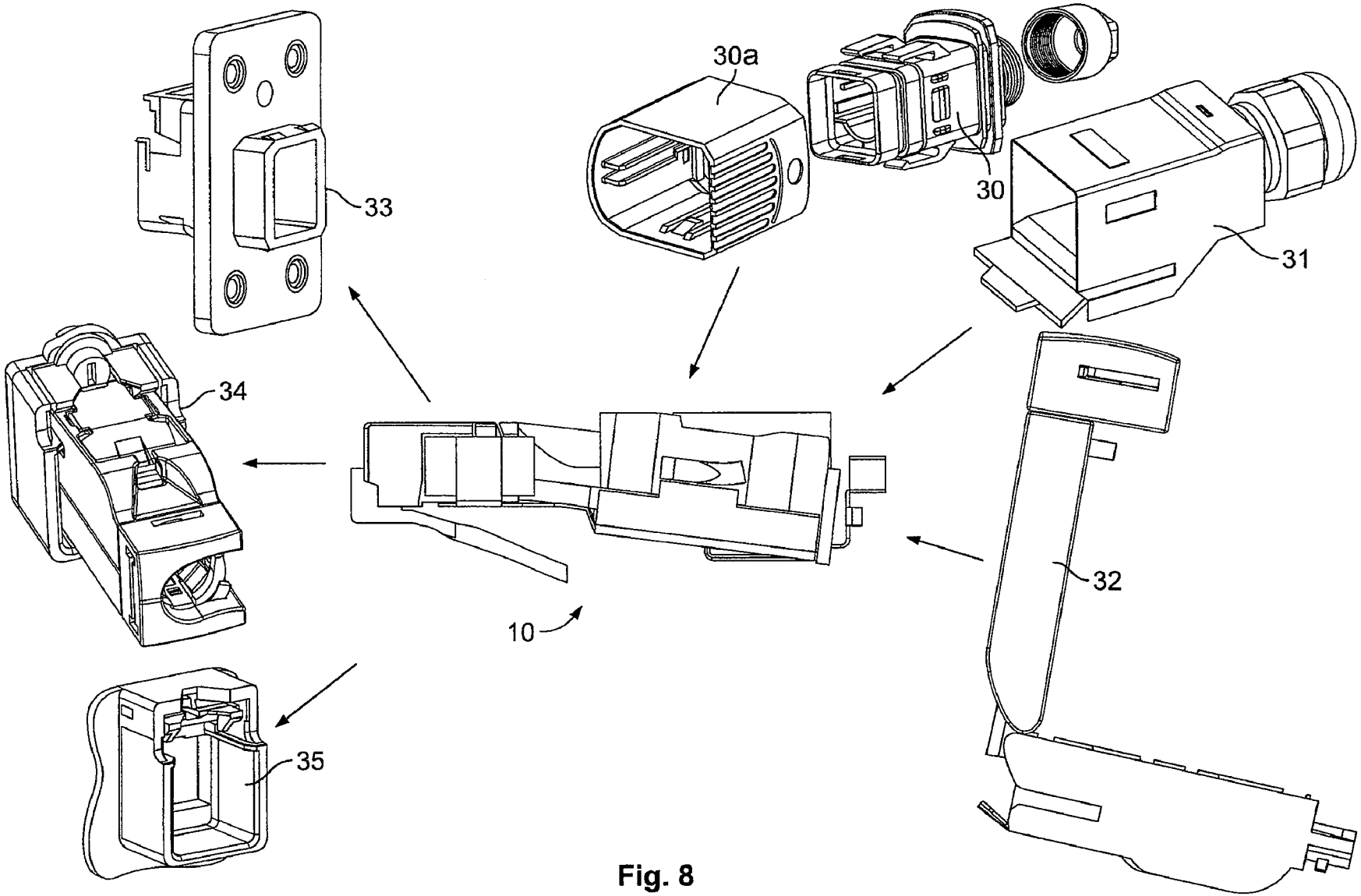
FIG. 8 is schematic illustration of a plurality of plug housings into which the electrical plug module can be installed.

As shown in FIG. 7, the second housing 11 has wire receiving openings 16 distributed over two separate planes in the second housing 11. A plurality of the wire receiving openings 16 in each of the planes are separated into separate correspondingly shaped recesses in the second housing 11. The wire receiving openings 16 are arranged in the correspondingly shaped recesses, in order not to damage the individual conductors 41 during subsequent fitting in a plug housing 30, 31, 32 (FIG. 8). The wire receiving openings 16 correspond to the insulation displacement contacts 13 such that upon introduction of the individual conductors 41 through the wire receiving openings 16, the individual conductors 41 are automatically guided over the respective insulation displacement contacts 13 and the shield plates 22 so that any superfluous wire ends of the individual conductors 41 may be subsequently cut off.

As shown in FIG. 5, in substantially a center of the second housing 11 are ejection openings 17, which correspond to the wire receiving openings 16, through which the cut-off wire ends may be ejected. The ejection openings 17 are configured such that the individual conductors 41 are pushed far enough through the wire receiving openings 16 that their wire ends project out of the ejection openings 17 to ensure that all the individual conductors 41 have been reliably contacted.

The second housings 11 has a bearing edge 24*b* corresponding to the bearing edge 24*a* of the first housing 12. The bearing edges 24*a*, 24*b* are configures such that the first and second housings 12, 11 can rotate relative to one another by providing an axis of rotation. For axial centering, a pin is provided on the first housing 12 on a center axis, which engages in a corresponding recess in the second housing 11 and thus prevents lateral slipping. To connect the first housing 12 to the second housing 11, the first housing 12 is inserted from below through the orifice 27 in the second housing 11 and the bearing edge 24*a* is aligned with the bearing edge 24*b*.

As shown in FIG. 6, a locking member 28 projects from the second housing 11. The locking member 28 is configured to secure the electrical plug module 10 in a plug housing 30, 31, 32 (FIG. 8) against withdrawal.

Operation of the electrical plug module 10 will now be described. The electrical plug module 10 is first arranged in an open position where the second and first housings 11, 12 have been rotated apart, as shown in FIG. 1. In the open position, one end of the second housing 11 is raised to create to an enlarged fitting space inside the electrical plug module 10. Thus, it is possible to connect individual conductors with large external diameters, for example about 1.6-1.7 millimeters. The individual conductors 41 may have, for example, a wire cross-section ranging from AWG 22 to AWG 24.

To connect the cable 40, the outer cable jacket is stripped off such that the metal shield 42 is exposed. In this way, the individual conductors 41 become visible and may be color-sorted for introduction into the wire receiving openings 16. The individual conductors 41, however, are not stripped. In the open position, the individual conductors 41 are introduced into the wire receiving openings 16. To produce an electrical connection, the individual conductors 41 are passed over the insulation displacement contacts 13 and over the cutting devices of the shield plates 22. The individual conductors 41 are inserted into the electrical plug module 10 until the metal shield 42 rests on the metal clip 29. When the second and first housings 11, 12 are rotated to the closed position shown in FIG. 2, the cutting devices of the shield plates 22 cut all the individual conductors 41 that have been introduced to an intended length in quick succession.

As the second and first housings 11, 12 are pressed further together, the individual conductors 41 are then pressed into the corresponding insulation displacement contacts 13. The cut-off ends of the individual conductors 41 then fall into the outlet channels 20, 21. In this way it is ensured that the ends are cut to precisely comply with a predetermined wire length and no separate operation is necessary for cutting off the ends. During the rotation of the second and first housings 11, 12, force is distributed in a succession of steps, such that no individual force peaks can arise during contacting and cutting off. The second and first housings 11, 12 are preferably pressed together with, for example, pliers, such that the hooks of the latching device 19 hook into the corresponding eyelets and thus lock the second and first housings 11, 12 in the closed position.

After pressing into the insulation displacement contact 13, the ends of the contacted individual conductors 41 arrive in a region of the opening 22*a*, such that short circuits with the shield plate 22 are prevented. The cut-off ends of the individual conductors 41 are ejected via the outlet channels 20, 21. After cutting, all the individual conductors 41 project as far as the respective shield plate 22. It is thereby ensured that with each plug connection the individual conductors 41 are in pairs of the same length, which is important in particular with high frequency signals. Additionally, both the metal clip 29 and the resilient contact 18 are connected to the shield plates 15, which are arranged around the plug module 10. As a result of the contact between the metal clip 29 and the resilient contact 18 and the metal shield 42 of the cable 40, reliable continuation of shielding is ensured.

In the electrical plug module 10, a plurality of the individual conductors 41 can be contacted at the same time in a single operation. Moreover, the metal shield 42 of the cable 40 is automatically contacted in the same operation. Excess ends of the individual conductors 41 are likewise cut off automatically with the cutting device. The cut-off ends are removed from the electrical plug module 10 through the outlet channels 20, 21. The cable 40 is then connected with its individual conductors 41 firmly to the plug module 10 and may be installed in a corresponding protective plug housing 30, 31, 32 (FIG. 8).

Because the electrical plug module 10 does not require any covers, fitting devices, adjusting devices or the like, the electrical plug module 10 is of a simple construction in that the first and second housings 12, 11 simply and easily fit the individual conductors 41 in just one operation. A particularly advantageous feature is that, due to the construction of the first and second housings 12, 11, it is even possible to fit the individual conductors 41 having the external diameter of more than about 1.5 millimeters without difficulty and without the expenditure of much force. Additionally, since the first housing 12 is inserted substantially obliquely into the second housing 11, the internal space or the fitting space in the electrical plug module 10 is enlarged, such that it is possible to fit the individual conductors 41 with the thicker external diameters without difficulty. Further, contacting of the individual conductors 41 with the insulation displacement contacts 13 occurs by simple pressing together of the first and second housings 12, 11.

The electrical plug module 10 is of a universal construction and may be used as an insert in various types of plug housings 30, 31, 32, as shown in FIG. 8. FIG. 8 shows, by way of example, three different types of the plug housing 30, 31, 32. For example, the plug housing 30 is a push-pull housing. The electrical plug module 10 is inserted into a front of the plug housing 30 and is then locked into position by a latch member. A strain relief member is then attached onto a rear of the plug housing 30 and receives the cable. A contact member 30*a* is then pushed onto the front of the plug housing 30 and locked into position by a latch member.

In another example, the plug housing 31 is a substantially light housing made, for example, from a plastic material. The electrical plug module 10 is inserted into a front of the plug housing 31 and is then latched into position.

In a further example, the plug housing 32 is a substantially robust two-part housing made, for example, from metal. For fitting of the plug module 10, the two-part housing is first rotated from a closed position to an open position to reveal an electrical plug module receiving opening. The electrical plug module 10 is then inserted into the electrical plug module receiving opening. The two-part housing is then rotated back into the closed position and attached to a strain relieving member.

The plug housing 30, 31, 32 are then mechanically and electrically connected to housing interfaces 33, 34, 35, as shown in FIG. 8. FIG. 8 shows, by way of example, three different types of the housing interfaces 33, 34, 35. The housing interface 33 is a device socket, for example, for a computer casing or like. The plug housing 30, which is the push-pull housing, is constructed for use with the housing interface 33. The plug housing 30 and the housing interface 33 are connected, for example, by a push-pull latching method.

In another example, the housing interface 34 has a threaded connector on a front surface thereof that provides a screw connection with either the plug housing 31 or the plug housing 32. The plug housings 31, 32 have a lug with at least one bore that may be screwed together with the threaded connector on the housing interface 34 by at least one threaded screw.

In a further example the housing interface 35 is provided with an interlocking connection. The interlocking connection functions similarly to the push-pull latching method. The plug housing 30 is introduced into the housing interface 35 and secured thereto with, for example, a clip or a latch.

The foregoing illustrates some of the possibilities for practicing the invention. Many embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical plug module, comprising:

a first housing having terminal contacts and insulation displacement contacts arranged therein, each of the insulation displacement contacts being electrically connected to one of the terminal contacts by a conductor track;

a second housing having wire receiving openings for receiving individual conductors of a cable, the wire receiving openings corresponding to the insulation displacement contacts, the wire receiving openings being arranged in at least two separate planes; and the first housing and the second housing being rotatable relative to one another between an open position and a closed position, the individual conductors being insertable into the wire receiving openings in the open position and being electrically connected to the insulation displacement contacts in the closed position.

2. The electrical plug module of claim 1, wherein the insulation displacement contacts are staggered.

3. The electrical plug module of claim 1, further comprising a latching device that secures the first housing to the second housing in the closed position.

4. The electrical plug module of claim 1, wherein the first housing extends substantially obliquely to the second housing in the open position.

5. The electrical plug module of claim 1, wherein the first housing has eight wire receiving openings.

6. The electrical plug module of claim 1, wherein the wire receiving openings are formed in shaped recesses formed in the second housing.

7. The electrical plug module of claim 1, wherein the wire receiving openings and the insulation displacement contacts are arranged in pairs.

8. The electrical plug module of claim 7, wherein each of the pairs of insulation displacement contacts is separated by a central shield plate and a shield plate extending substantially transverse to the central shield plate.

9. The electrical plug module of claim 1, further comprising cutting devices arranged adjacent to the insulation displacement contacts for cutting ends of the individual conductors during rotation of the first housing from the open position to the closed position.

10. The electrical plug module of claim 9, wherein the cutting devices are integrally formed on shield plates arranged substantially parallel to the insulation displacement contacts.

11. The electrical plug module of claim 10, wherein the shield plates have openings that receive the individual conductors when the first housing is in the closed position.

12. The electrical plug module of claim 9, when the first housing includes at least one outlet channel arranged adjacent to the cutting devices.

* * * * *